US007232019B2

(12) United States Patent
Chang et al.

(10) Patent No.: US 7,232,019 B2
(45) Date of Patent: Jun. 19, 2007

(54) SEAMLESS HANDLE GRIP OF LUGGAGE

(75) Inventors: Shih Yu Chang, Taipei (TW); Chung-Hsien Kuo, Pan-Chiao (TW); Chia-Hsien Lin, Taipei (TW)

(73) Assignee: Chaw Khong Technology Co., Ltd., Wu Ku Hsiang (TW)

( * ) Notice: Subject to any disclaimer, the term of this patent is extended or adjusted under 35 U.S.C. 154(b) by 631 days.

(21) Appl. No.: 10/799,735

(22) Filed: Mar. 15, 2004

(65) Prior Publication Data

US 2004/0182666 A1 Sep. 23, 2004

(51) Int. Cl.
*A45C 13/26* (2006.01)

(52) U.S. Cl. ..... 190/115; 16/113.1

(58) Field of Classification Search ..... 190/115; 16/113.1

See application file for complete search history.

(56) References Cited

U.S. PATENT DOCUMENTS

| | | | | |
|---|---|---|---|---|
| 5,706,921 | A * | 1/1998 | Wang | 190/115 |
| 6,591,951 | B1 * | 7/2003 | Chen | 190/115 |
| 6,702,164 | B1 * | 3/2004 | De Lathouwer | 224/153 |
| 6,830,135 | B2 * | 12/2004 | Lin et al. | 190/115 |
| 7,011,195 | B1 * | 3/2006 | Kho | 190/18 A |
| 2005/0279600 | A1 * | 12/2005 | Goldwitz | 190/115 |

* cited by examiner

*Primary Examiner*—Tri M. Mai

(57) ABSTRACT

A seamless handle grip assembly mounted on a single pulling rod of luggage is provided. The assembly comprises a tube a top grip section, a spring depressible push button a hollow, cylindrical left member inserted into a left portion of the tube, a hollow, cylindrical right member inserted into a right portion of the tube to matingly couple to the left member, a bottom grip section threadedly secured to the top grip section with the tube fastened therebetween, and a rod inserted upwardly through the bottom grip section into the tube and the spring to fixedly couple to the push button.

10 Claims, 5 Drawing Sheets

SEAMLESS HANDLE GRIP OF LUGGAGE

BACKGROUND OF THE INVENTION

1. Field of the Invention

The present invention relates to handle grip of luggage and more particularly to a seamless handle grip mounted in a single pulling rod of luggage case.

2. Description of Related Art

Some types of luggage (e.g., wheeled luggage) have only a single pulling rod. For a handle grip formed on top of such pulling rod, it typically comprises an upper portion, an equal lower portion, and a push button on the upper portion. A seam is formed between a joining edge of the portions. Such seam can adversely affect a degree of comfort while holding the handle grip due to its sharp edge. A solution to the above is to improve the molds so as to substantially eliminate the seam in the manufacturing process. However, it may greatly increase the manufacturing cost. Thus, it is desirable to provide a seamless handle grip in order to overcome the above drawback of the prior art.

SUMMARY OF THE INVENTION

It is an object of the present invention to provide a seamless handle grip assembly mounted on a single pulling rod of luggage case, comprising a tube including an intermediate top opening; a top grip section including a top curved surface, a top central opening, and two bottom posts having inner threads; a spring depressible push button including a spring biased against a bottom, a circumferential bottom flange having a periphery longer than a bottom periphery of the top opening of the tube for preventing the push button mounted in the top opening of the tube from disengaging; a hollow, cylindrical left member including an enclosed left end, a top cavity at an open right end, a first positioning member adjacent the right end wherein the left member is snugly inserted into a left portion of the tube; a hollow, cylindrical right member including an enclosed right end, a top cavity at an open left end, a second positioning member adjacent the left end wherein the right member is snugly inserted into a right portion of the tube with the first positioning member matingly engaged with the second positioning member so as to confine the spring between the left and right members; a bottom grip section including a bottom curved surface, an intermediate hollow neck, and a bottom hollow section coupled to a pulling rod wherein two fasteners are driven through the curved surface of the bottom grip section, the tube, and the left and the right members into the posts for coupling the bottom and the top grip sections together with the tube fastened therein; and a rod inserted upwardly through the bottom grip section into the tube and the spring to fixedly couple to the push button.

The present invention has the following advantages:

The joining edge of the top and bottom grip sections is seamless so as to provide a degree of comfort while holding the handle grip in towing a luggage case.

The structural strength is enhanced.

It has an aesthetic appearance.

Its manufacturing cost is greatly reduced.

Most importantly, it is trouble free for long period of time of use.

The above and other objects, features and advantages of the present invention will become apparent from the following detailed description taken with the accompanying drawings.

DETAILED DESCRIPTION OF THE PREFERRED EMBODIMENTS

Figure 1:
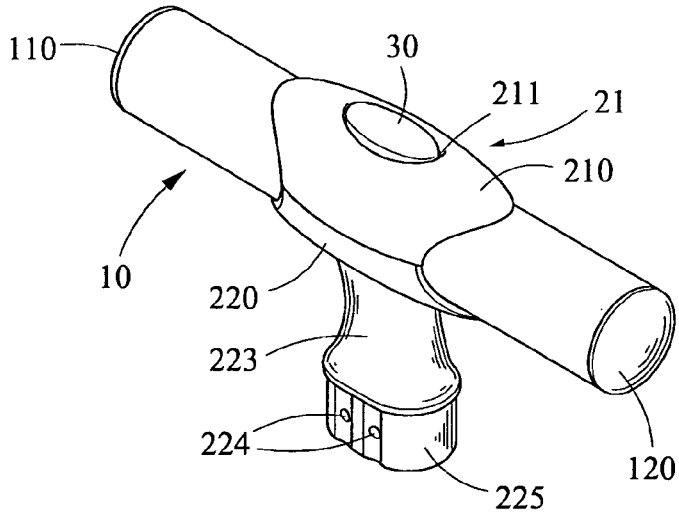
FIG. 1 is a perspective view of a handle grip mounted on top of a single pulling rod of luggage according to the invention.
Figure 2:
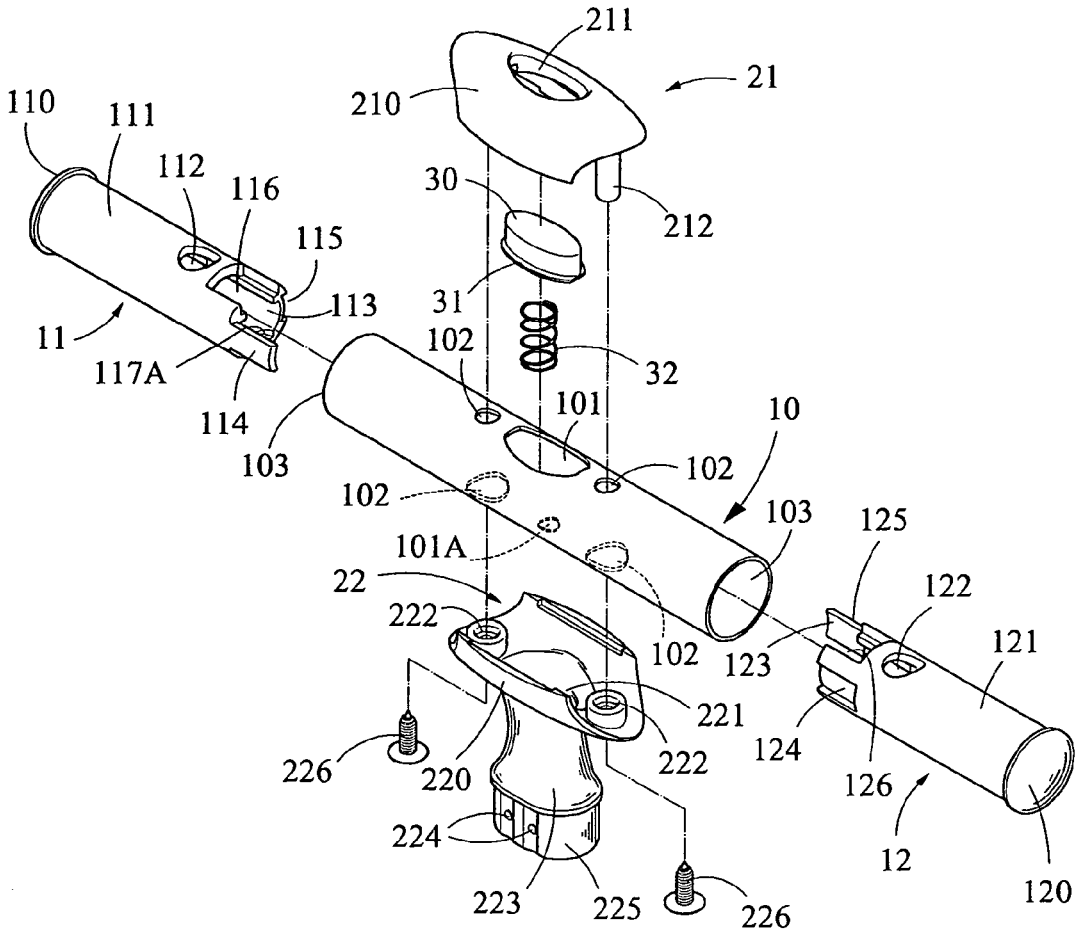
FIG. 2 is an exploded view of the handle grip in FIG. 1.
Figure 3:
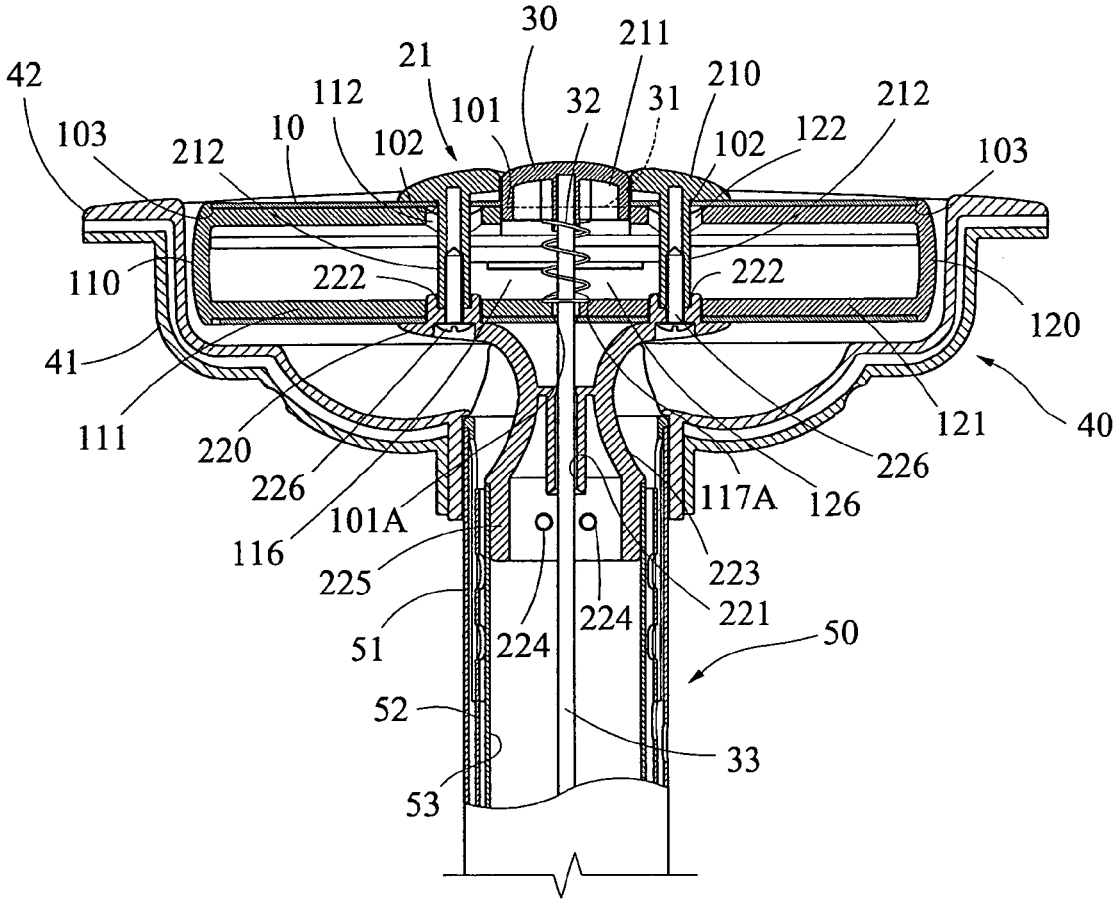
FIG. 3 is a sectional view showing the handle grip mounted in a bezel on top of luggage and associated components in a nonoperating position.

Referring to FIGS. 1 to 6, there is shown a seamless handle grip assembly mounted in a single pulling rod of luggage case in accordance with the invention. The handle grip assembly comprises a tube 10 including an intermediate top opening 101, two top apertures 102 at both sides of the top opening 101, an intermediate bottom hole 101A, and two bottom apertures 102 at both sides of the bottom hole 101A; a top grip section 21 including a top curved surface 210, a top central opening 211, and two bottom posts 212 having inner threads inserted into the apertures 102; a push button 30 including a circumferential bottom flange 31 having a periphery longer than a bottom periphery of the opening 211 for preventing the push button 30 mounted in the opening 211 from moving out of the opening 211 upwardly; a spring 32 under the push button 30; a left cap 11 including a hollow cylinder 111, an enclosed left end 110 having an annular flange, a through opening 112, a top cavity 116 open to an open end 113, a transverse projection 114 protruded inwardly from the open end 113, a transverse recess 115 opposite to the projection 114, and a bottom aperture 117A at the open end 113 wherein the left cap 11 is snugly inserted into a bore 103 of the tube 10 with a left end of the tube 10 engaged with the flange at the left end 110, the through opening 112 aligned with the left apertures 102, and the cavity 116 aligned with the top opening 101; a right cap 12 including a hollow cylinder 121, an enclosed right end 120 having an annular flange, a through opening 122, a top cavity 126 open to an open end 123, a transverse projection 125 protruded inwardly from the open end 123, and a transverse recess 124 opposite to the projection 125 wherein the right cap 12 is snugly inserted into the bore 103 of the tube 10 with a right end of the tube 10 engaged with the flange at the right end 120, the through opening 122 aligned with the right apertures 102, the cavity 126 aligned with the top opening 101, the projection 125 snugly fitted in the recess 115, and the projection 114 snugly fitted in the recess 124 so as to couple the left and the right caps 11 and 12 together and confine the spring 32 between the intermediate bottom hole 101A and the push button 30; an upright rod 33 (see FIGS. 3 and 4) upwardly inserted through the intermediate bottom hole 101A and the spring 32 into a tubelike member under the push button 30 for anchoring the spring 32; and a bottom grip section 22 including a bottom curved surface 220, a top central opening 221, two posts 222 having inner threads at both sides of the opening 221, an intermediate hollow neck 223, a bottom hollow section 225, two apertures 224 at front and rear sides of the section 225, and two screws 226 wherein the rod 33 is inserted through the opening 221, the neck 223, and the section 225, and each screw 226 is driven through the post 222, the aperture 102, and the post 212 for coupling the bottom and top grip sections 22 and 21 together with the tube 10 fastened therein.

Figure 4:
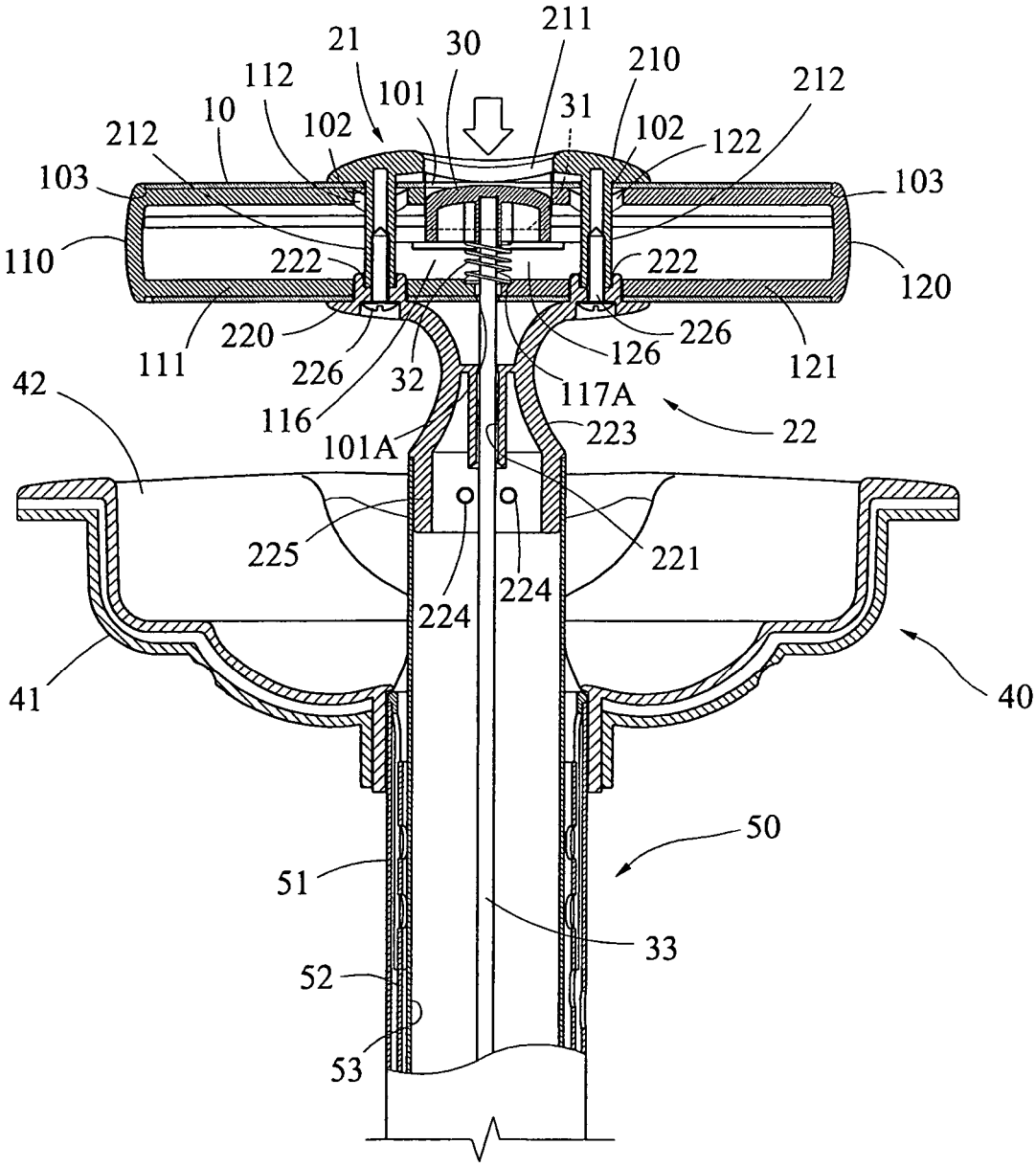
FIG. 4 is a view similar to FIG. 3, where the handle grip is lifted in an operating position.
Figure 5:
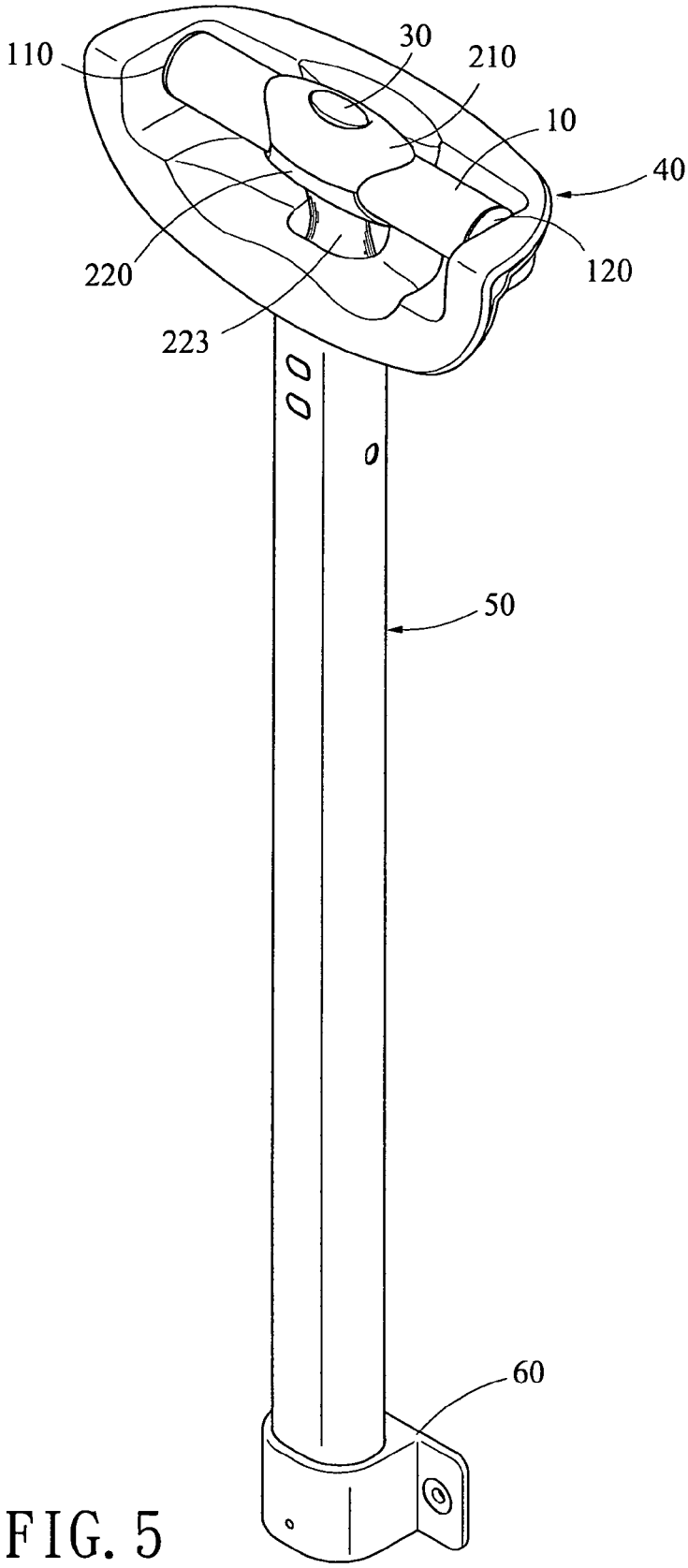
FIG. 5 is a perspective view of the handle grip, the bezel, and the pulling rod in FIG. 3.
Figure 6:
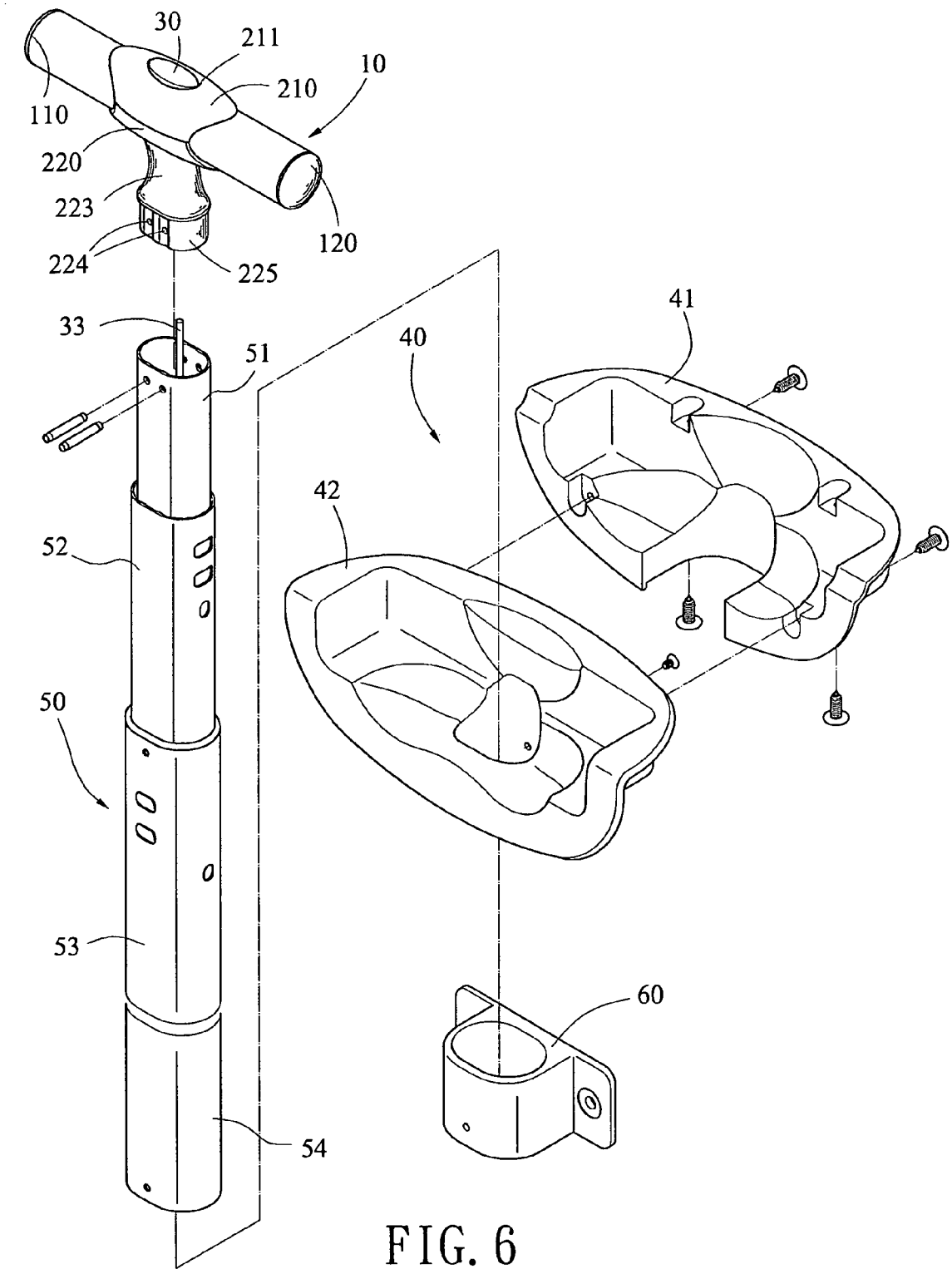
FIG. 6 is an exploded view of the components shown in FIG. 5.

Referring to FIGS. 4 and 5 specifically, the handle grip assembly is mounted on a bezel 40, which comprises an inner section 41 and an outer section 42 threadedly secured to the inner section 41. Also, the bezel 40 is threadedly secured on a top of luggage case. Further, a single pulling rod 50 comprises a bottom support tube 54 secured to a socket on a bottom of luggage case, a lower sliding tube 53, an intermediate sliding tube 52, and an upper sliding tube 51 fixedly coupled to the section 225 by driving fasteners through top holes of the sliding tube 51 and the apertures 224. Furthermore, the rod 33 is inserted through the pulling rod 50 to couple to a handle locking device (not shown) such that a pressing of the push button 30 can unlock the handle for pulling the handle grip thereafter in a technique known in the art. Thus a detailed description thereof is omitted herein for the sake of brevity.

Note that the tube 10 can have an oval section or any other section other than above in other embodiments.

It will be evident from the foregoing that the invention has the following advantages: The joining edge of the top and bottom grip sections 21 and 22 is seamless so as to provide a degree of comfort while holding the handle grip in towing a luggage case. Moreover, the structural strength is improved so as to be trouble free. In addition, it has an aesthetic appearance due to its metal (e.g., aluminum) characteristics. Additionally, its manufacturing cost is greatly reduced.

While the invention herein disclosed has been described by means of specific embodiments, numerous modifications and variations could be made thereto by those skilled in the art without departing from the scope and spirit of the invention set forth in the claims.

What is claimed is:

1. A seamless handle grip assembly mounted on a top bezel of a luggage case, comprising:

a tube including an intermediate top opening;

a top grip section including a top curved surface, a top central opening, and two bottom posts;

a spring depressible push button including a spring biased against a bottom;

a hollow, cylindrical left member including an enclosed left end, wherein the left member is snugly inserted into a left portion of the tube;

a hollow, cylindrical right member including an enclosed right end, wherein the right member is snugly inserted into a right portion of the tube;

a bottom grip section including a bottom curved surface and a bottom hollow section coupled to a single pulling rod wherein the curved surface of the bottom grip section, the tube, the left and the right members and the posts for coupling the bottom and the top grip sections are fastened together with the tube fastened therein; and a rod inserted upwardly through the bottom grip section into the tube and the spring to fixedly couple to the push button.

2. The seamless handle grip assembly of claim 1, wherein the push button further comprises a circumferential bottom flange having a periphery longer than a bottom periphery of the top opening of the tube for preventing the push button mounted in the top opening of the tube from disengaging.

3. The seamless handle grip assembly of claim 1, wherein the left member further comprises a top cavity at an open right end and a first positioning member adjacent the right end.

4. The seamless handle grip assembly of claim 1, wherein the right member further comprises a top cavity at an open left end and a second positioning member adjacent the left end.

5. The seamless handle grip assembly of claim 4, wherein the right member further comprises the first positioning member matingly engaged with the second positioning member so as to confine the spring between the left and right members

6. The seamless handle grip assembly of claim 1, wherein the bottom grip section further comprises an intermediate hollow neck between the bottom curved surface and the bottom hollow section.

7. The seamless handle grip assembly of claim 1, wherein the left member further comprises an annular flange formed at the left end thereof and the right member further comprises an annular flange formed at the right end thereof.

8. The seamless handle grip assembly of claim 3, wherein the first positioning member comprises a transverse first projection and a transverse first recess opposite the first projection.

9. The seamless handle grip assembly of claim 4, wherein the second positioning member comprises a transverse second projection matingly engaged with the first recess of the first positioning member and a transverse second recess opposite the second projection matingly engaged with the first projection of the first positioning member.

10. A seamless handle grip assembly mounted on a single pulling rod of luggage comprising:

a tube;

a top grip section enclosing a portion of the tube;

a spring depressible push button provided on a middle top of the tube;

a hollow, cylindrical left member inserted into a left portion of the tube;

a hollow, cylindrical right member inserted into a right portion of the tube to matingly couple to the left member;

a bottom grip section threadedly secured to the top grip section with the tube fastened therebetween; and a rod inserted upwardly through the bottom grip section into the tube and the spring to fixedly couple to the push button.

* * * * *